United States Patent [19]

Stone

[11] 4,240,546

[45] Dec. 23, 1980

[54] BASKET-TYPE CARRIER FOR BOTTLES AND METHOD OF FORMING THE SAME

[75] Inventor: Orison W. Stone, New Haven, Vt.

[73] Assignee: Pack Image, Inc., Middlebury, Vt.

[21] Appl. No.: 52,491

[22] Filed: Jun. 27, 1979

[51] Int. Cl.[3] ..... B65D 5/24; B65D 5/46; B65D 5/48; B65D 85/62

[52] U.S. Cl. ..... 206/193; 206/427; 229/28 BC; 229/52 B; 229/52 BC

[58] Field of Search ..... 206/139, 141, 142, 143, 206/162, 180, 193, 195, 198, 427; 229/28 BC, 52 BC, 52 B

[56] References Cited

U.S. PATENT DOCUMENTS

| | | | |
|---|---|---|---|
| Re. 29,063 | 12/1976 | Graser | 206/141 |
| 2,556,069 | 6/1951 | Currie et al. | 206/195 |
| 2,797,845 | 7/1957 | Guyer et al. | 229/28 BC |
| 2,850,223 | 9/1958 | Strauss | 229/52 BC |
| 3,119,515 | 1/1964 | Kursh | 206/198 |
| 3,255,919 | 6/1966 | Koolnis | 206/195 |
| 3,977,518 | 8/1976 | Arneson | 206/141 |
| 4,034,852 | 7/1977 | Forrer | 206/141 |

*Primary Examiner*—William T. Dixson, Jr.
*Attorney, Agent, or Firm*—Wood, Herron & Evans

[57] ABSTRACT

A carrier for bottles is formed from a paperboard tube having top, button and end walls. The upper corners of the tube are gusseted so that the top wall may be swung downwardly on each side of a center line to form a center partition. The end walls have serially-connected, minor flaps and double thickness dividers which are swung inwardly around bottles at the four corners of the carrier with the dividers creating three cells on each side of the carrier. A major flap is hinged to each side of the bottle wall and is glued to the minor flaps to complete the formation of the carrier.

18 Claims, 26 Drawing Figures

BASKET-TYPE CARRIER FOR BOTTLES AND METHOD OF FORMING THE SAME

This invention relates to a bottle carrier, and more particularly, to a basket-type carrier designed for glass bottles.

In general, a basket-type carrier has a bottom wall, side and end walls, a center partition, and transverse dividers to form three cells on each side of the center partition. I.C.C. regulations require that bottles be separated from each other by a minimum of 0.040 inch (40 point) thickness of board. It is therefore customary to manufacture the carrier from 21 point board and design the carrier so as to provide double thicknesses of board in those areas which space the bottles apart.

These design requirements have generated very complex, flat blanks having multiple, rather precisely positioned, glue spots to permit doubling over of paperboard sections as well as the other forming steps. The complex pattern of glue spots has required timed gluers which are able to deposit glue in the desired pattern. The converting machines which employ timed gluers are slow and expensive.

The carrier resulting from this complexity is functional but not particularly attractive. It has some additional disadvantages, included among which are the fact that it is structurally weak and in particular its bottom wall sags away from the rest of the structure when loaded with bottles; the carrier must be loaded by depositing bottles downwardly into the carrier, and it is possible to abrade the labels on the bottles as they are thus deposited into the carrier; the center partition has a hole cut from the upper portion of it to form a handle; and the edge of the handle is uncomfortable to a person's fingers carrying a loaded 6-pack.

It has been an objective of the present invention to provide an improved carrier having the following features:

(a) improved strength;
(b) an improved sculptured appearance;
(c) reduced complexity and capability of being run on a faster untimed straight line gluer;
(d) the capability of being side-loaded as contrasted to vertically-loaded, thereby avoiding scraping of labels;
(e) an improved comfortable handle;
(f) improved bottle cushioning to further minimize breakage.

This objective and these improved features are attained by several structural features of the carrier and the method of forming it. The carrier is first formed as a tube having a bottom wall, end walls and a top wall which is designed to move through a side loading machine generally of the type described in U.S. Pat. Nos. 3,174,259 and 3,225,510 with the axis of the tube oriented horizontally and perpendicular to the movement of the tube through the machine. In other words, the tube is open at its sides and closed by the front and rear walls as the tube moves through a machine. It should be recognized that the machine of the '259 patent will require some modification to adapt it to the carton of the present invention.

The upper four corners of the tube are provided with a gusset structure consisting of a minor triangular gusset panel taken from the end wall and a major triangular gusset taken from the top wall. The apexes of the gussets are spaced from each other at the central portion of the top wall in order to create the sculptured effect referred to above and to provide ready removability of full or empty bottles from the carrier.

The two sides of the top wall are folded downwardly through approximately 90° to form a two-ply center partition. The two plies are folded on a center fold line which does not extend all the way to each end wall. The ends of the fold line cooperate with the apexes of the gusset structure to create at each end of the carrier a curved triangular section thereby imparting to the upper portion of the carrier a three-dimensional, sculptured appearance. The plies forming the center partition are preferably snapped into position by the horizontal movement of four bottles into the four corners of the carrier. Thus, the operation of loading the bottles performs the added function of participating in setting up the carrier. The center partition structure, as described above, has several additional advantages. It provides bracing and rigidity to the carrier. The downwardly-curving triangular sections reduce the height of the carrier at its end walls by about ¾ inch, thereby resulting in a saving of approximately 22 square inches of board per carrier. The full depth center partition provides double thickness protection between the two rows of bottles, and more particularly, the bottles at the corners are cushioned by virtue of the spacing apart of the partition plies by the triangular sections. The full depth center partition which exposes the printable side of the board can be used for additional advertising material. The center partition distributes the load bearing evenly down the end walls of the carrier to the bottom wall.

The end walls have serially-connected, laterally-extending, minor side flaps and double thickness dividers. The bottom wall has laterally-projecting major flaps. These major and minor flaps, together with the dividers, are adapted to enclose the carrier and provide cushioning dividers between three bottles on each side of the center partition.

In the side loading of the carton, the corner bottles have already been introduced to form the center partition as described above. Then the minor flaps are first swung through 90° to extend parallel to the center partition. In this attitude, the dividers slightly overlap and are also parallel to the center partition. As the center bottles are side-loaded into the carrier, they swing the center partitions through about 90° inwardly into the carrier to position the dividers between the center bottles and the corner bottles. Thereafter, the major flaps from the bottom walls are swung upwardly through 90° and glued to the minor flaps, thereby completing the formation of the carrier.

At the juncture between the double thickness dividers and the minor flaps, a vertical, elongated, shallow U-shaped cut is formed which results in an outwardly-projecting bracing tab when the dividers are in their final position. The bracing tabs are engaged by the major flaps when the major flaps are glued against the minor flaps and thereby frictionally hold the dividers in a cell-creating position perpendicular to the center partition. This is advantageous in the event that the carrier is to be used for a second trip in which event it would be run through a top loading or drop loading packer currently in regular operation at the bottler. The bracing tabs partially space the major flap from the minor flap, thereby creating an additional cushioning pocket.

In an alternative form of the invention, the dividers are more positively held in a position perpendicular to the center partition. The divider is formed with an arrowhead tab which is insertable into a slot in the minor flap to which the divider is hinged. The divider, the minor flap and the arrowhead tab thus form a right triangle with the divider perpendicular to the minor flap and the side wall when the major flap is glued in place. When the major flap is glued in place, glue applied to the projecting portion of the arrowhead tab positively secures the elements in the right triangle orientation thus positively assuring a carrier divided into six cells.

A finger-gripping handle is formed in the center partition at the upper portion thereof by cutting out an oval-shaped part of the partition and providing a shallow, arcuate score above the cut-out portion. When the user puts his fingers into the carrier and forces them against the upper edge created by the cut-out area, the fingers will swing the cushion tab outwardly about 90°, further swinging movement being prevented by the arcuate score. When the fingers of the user are removed, the memory of the board, imparted by the U-shaped score, causes the tab to return substantially to the plane of the center partition so that it does not provide an obstruction for removal of the bottles from the carrier.

The several features of the invention will become more readily apparent from the following detailed description taken in conjunction with the accompanying drawings in which:

FIG. 1 is a perspective view of the carrier of the present invention;

FIG. 1*a* is a fragmentary, perspective view of the cushion handle forming a part of the invention;

Figure 1:
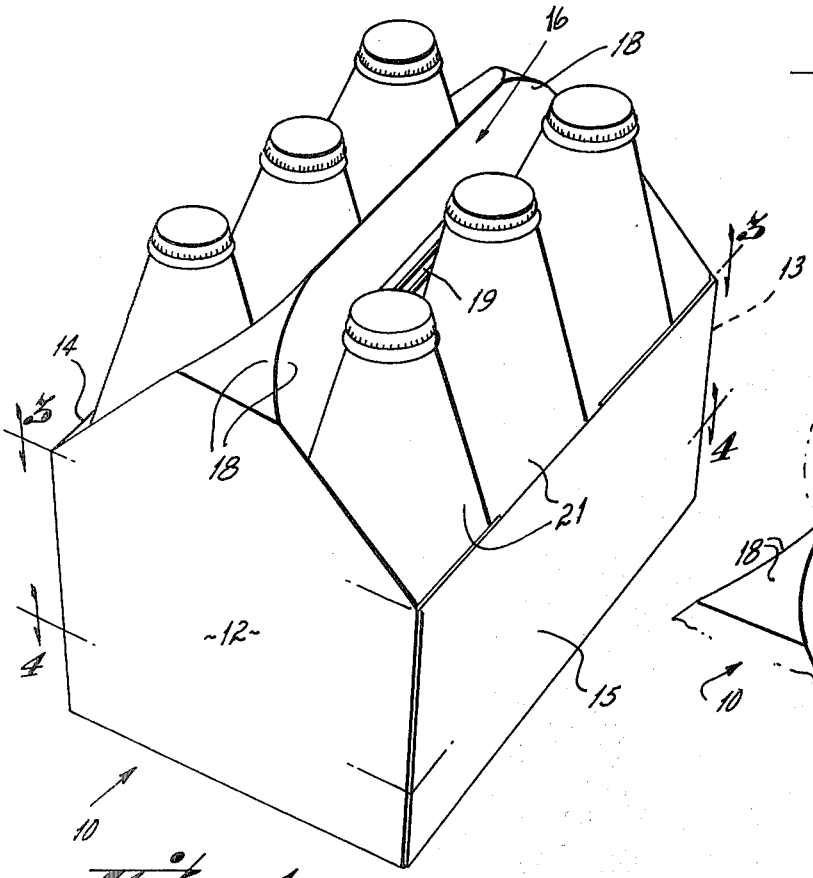

The carrier of the present invention is indicated at 10 in FIG. 1. It has a bottom wall 11 (not shown in that figure), end walls 12 and 13, and side walls 14 and 15. A center partition 16 extends across the end walls 12, 13 down to the full depth of the carrier. The partition is curved and three-dimensional as indicated at 18 at each end. A cut-out portion 19 forms a carrying handle for the carrier. Dividers 20 (FIGS. 3 and 4) project inwardly from the side walls 14, 15 to divide the carrier into six cells, three on each side, into which bottles 21 are loaded.

Figure 5:
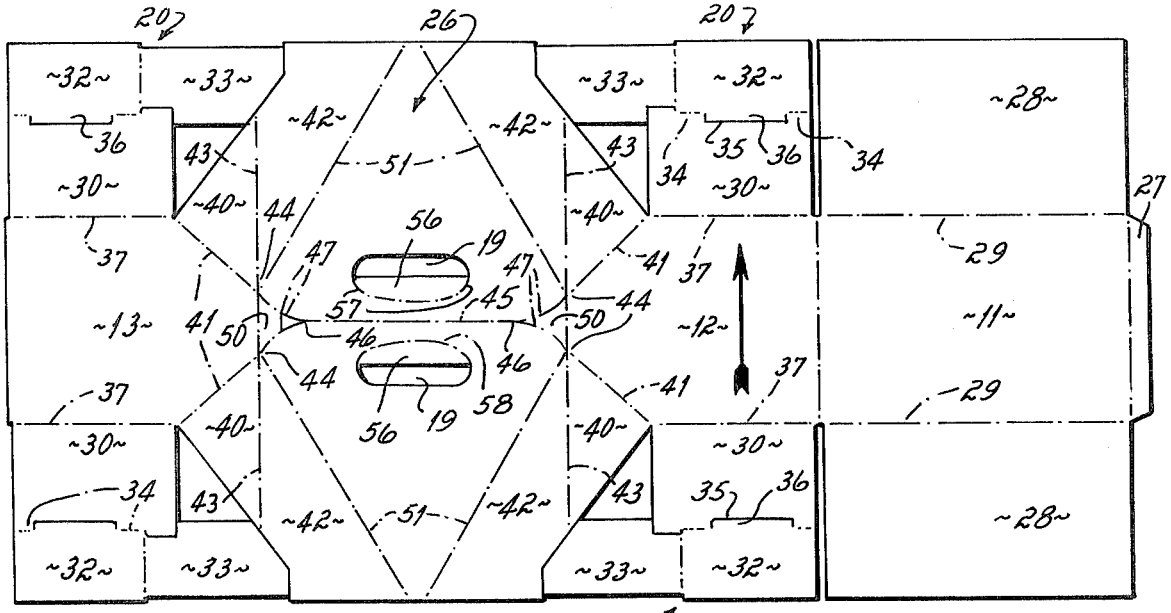
FIG. 5 is a plan view of a blank with the printed side up from which the carrier is constructed.
Figure 10:
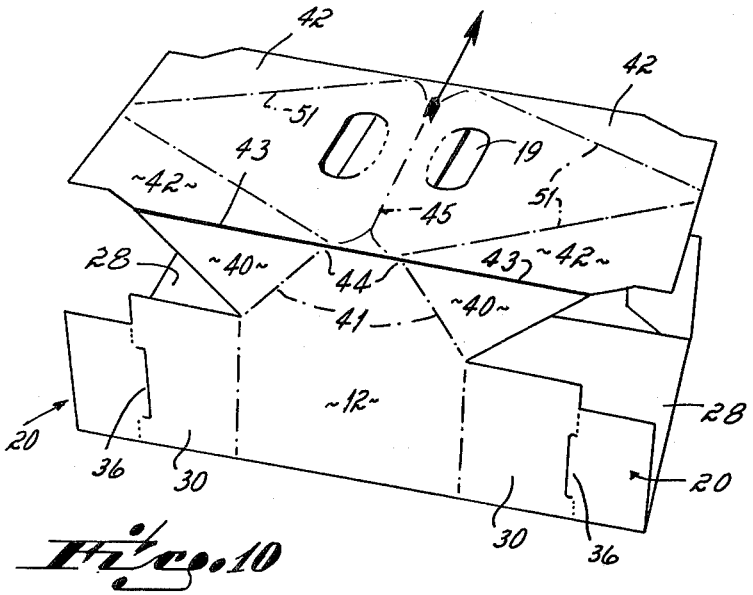
FIGS. 10–15 are perspective views illustrating the sequence of operations to erect and fill the carrier.

The carrier is formed from a blank shown at 25 in FIG. 5. The blank has panels forming serially-connected bottom wall 11, end wall 12, a top wall 26 which will form the partition 16, and an end wall 13. Bottom wall 11 has a glue flap 27 which will be connected to the end wall 13 to form a tube, the tube being illustrated in FIG. 10. The bottom wall 11 also has major side flaps 28 projecting laterally from it and hinged along score lines 29.

Each end panel 12, 13 has serially-connected a minor side flap 30 and a divider 20. The divider 20 is formed of two divider elements 32 and 33 which will be glued and folded upon each other to form a double thickness divider. The divider flap 20 is connected along hinge line 34 which is interrupted by a shallow, U-shaped cut 35 to form a brace tab 36. The minor side flap 30 is connected along hinge line 37 to the end walls 12 and 13.

The end wall 12 carries a minor gusset 40 connected to it along hinge line 41. The top panel 26 has a major gusset 42 hinged along line 43 to the minor gusset 40 and along line 51 to the remainder of the top panel 26 appearing in FIG. 5 as a triangular section. The two gusset portions 40 and 42 have coinciding apexes 44, the gusset apexes 44 on one side of the carrier being spaced from the gusset apexes 44 on the other side of the carrier.

The top wall has a central fold line 45 terminating in end points 46 which are spaced from the end walls 12, 13. The end points 46 are connected to the gusset apexes 44 by curved score line 47 which defines generally triangular-shaped sections 50.

The top panel 26 has an elongated cut-out portion 19 and a cushion tab 56 created by short cut arcs 57 and an elongated, arcuate fold line 58 whose function will be described below.

Figure 6:
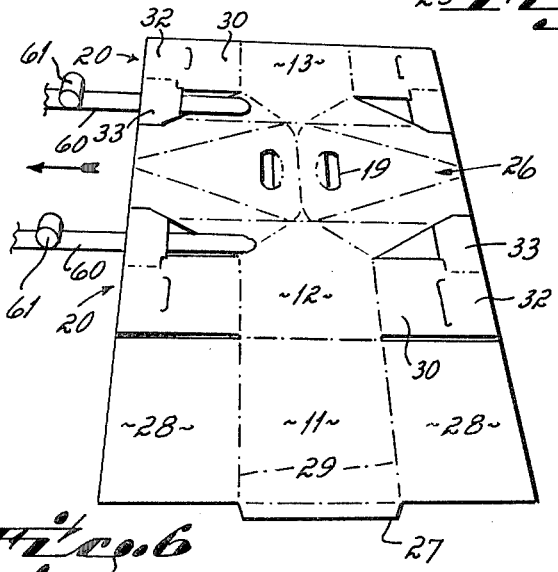
FIG. 6 is a perspective view of a first step in the converting process.
Figure 7:
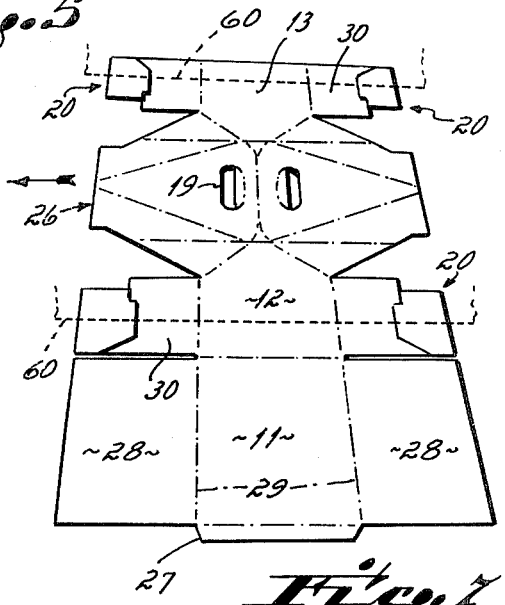
FIGS. 7–9 are perspective views printed side down and showing further steps in converting the blank of FIG. 5 to a flat folded blank of FIG. 9.

The carrier is initially formed as a flat, folded blank by the converter and then normally shipped to the bottler where it is erected and loaded with glass bottles. At the converters, the blank is run in the direction of the arrow, as illustrated in FIG. 5. The blank will pass over a spring or an air jet which will pop each of the divider flap elements 33 slightly upwardly (FIG. 6). The divider elements 33 will then pass over a plow 60 and glue will be applied by an untimed straight line gluer 61. The plow 60 is configurated to fold the flap completely over upon divider element 32, thereby providing the four double thickness dividers 20, as illustrated in FIG. 7.

Figure 8:
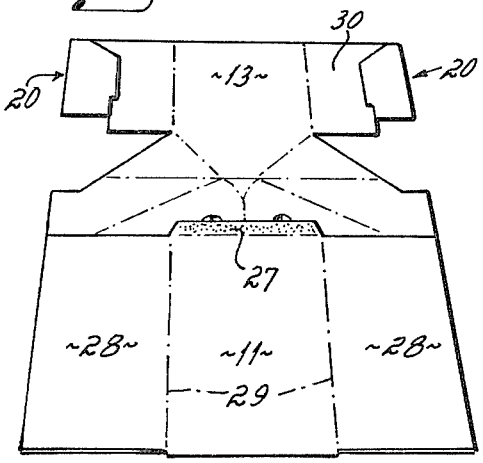
Figure 9:
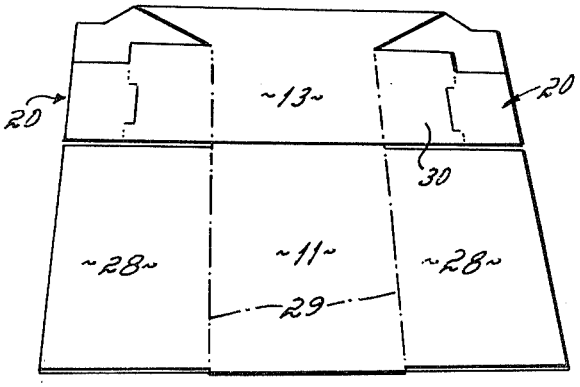

Glue is applied to the glue flap 27 and the bottom wall panel is folded over upon the end panel 12, as shown in FIG. 8. The end panel 13 is thereafter folded over onto the top panel and is adhesively secured at its edge to the glue flap 27 (FIG. 9). The blank is thus folded and glued at the converters in the very simple operations illustrated and described above. In the configuration of FIG. 9, the blank is ready for shipment to the bottler and to be run through the side-loading machines.

The erection on the carrier on the side-loading machines is illustrated in FIGS. 10–15. The carrier is first erected into a tube, illustrated in FIG. 10, the tube moving in the direction of the arrow.

Figure 3:
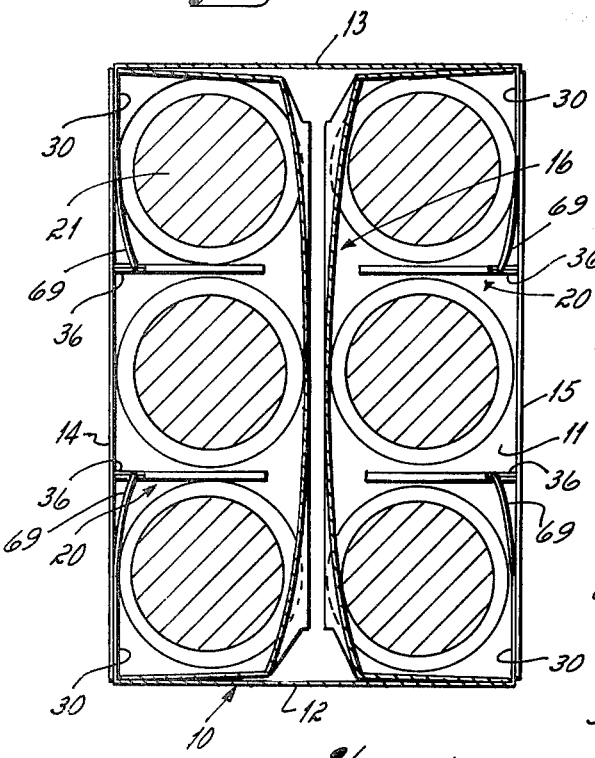
FIG. 3 is a cross-sectional view taken along lines 3—3 of FIG. 1.
Figure 4:
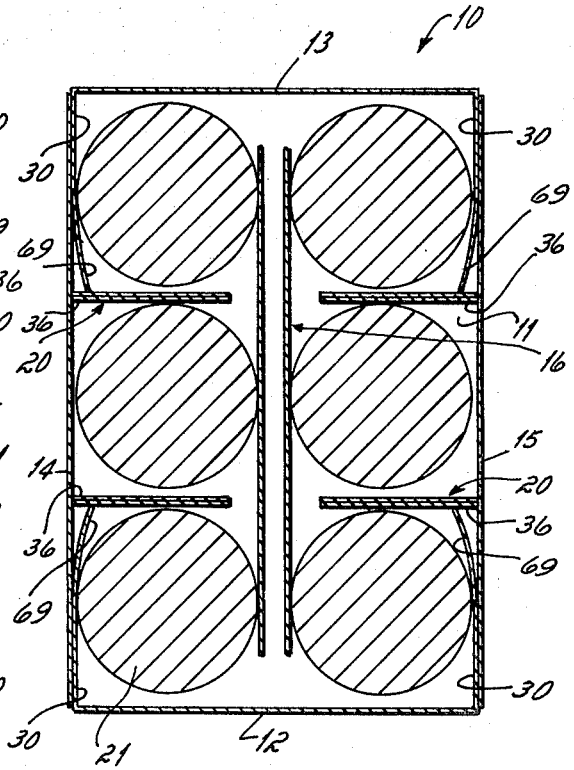
FIG. 4 is a cross-sectional view taken along lines 4—4 of FIG. 1.
Figure 11:
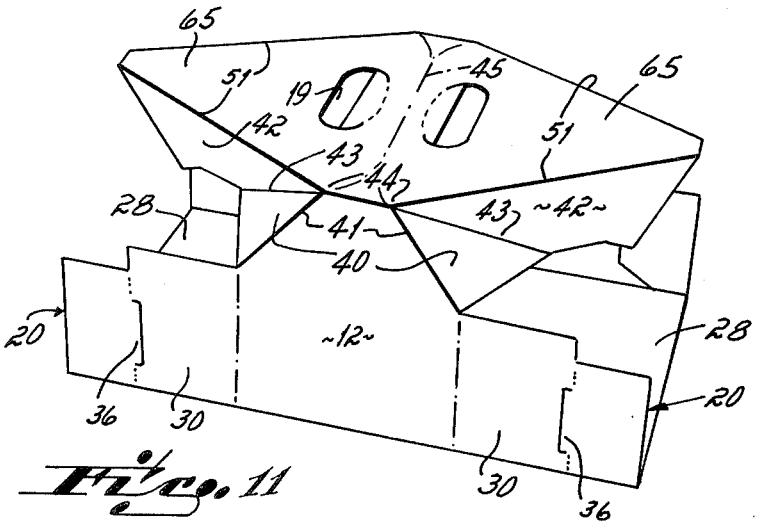
Figure 12:
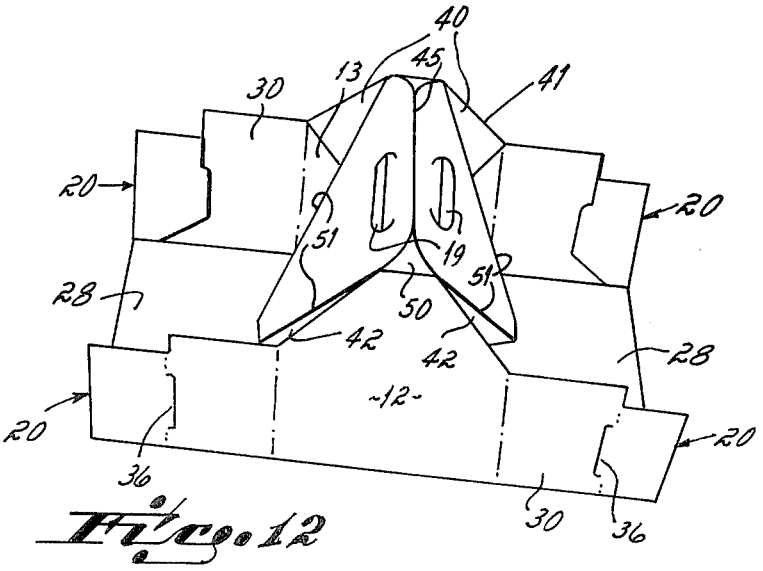
Figure 13:
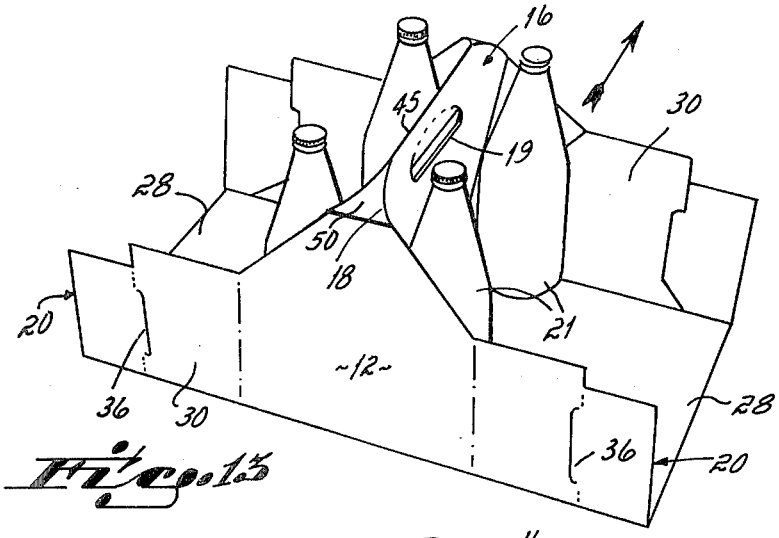
Figure 14:
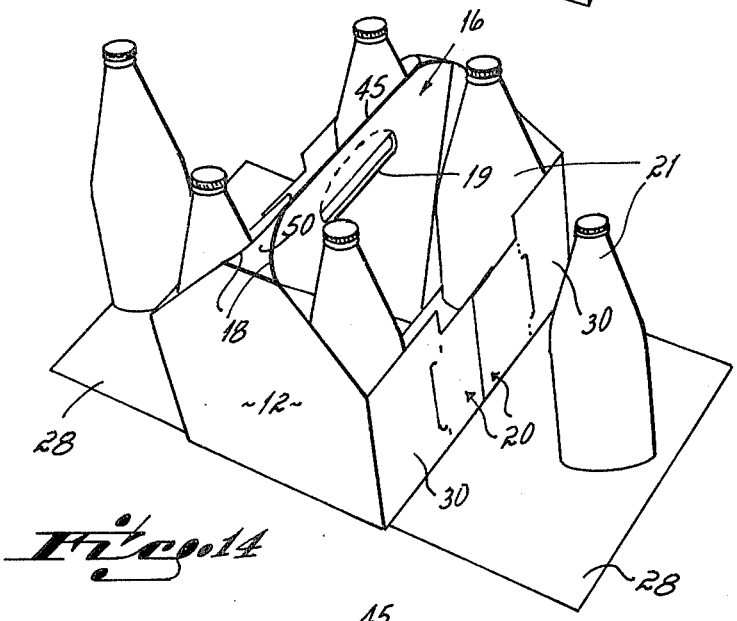
Figure 15:
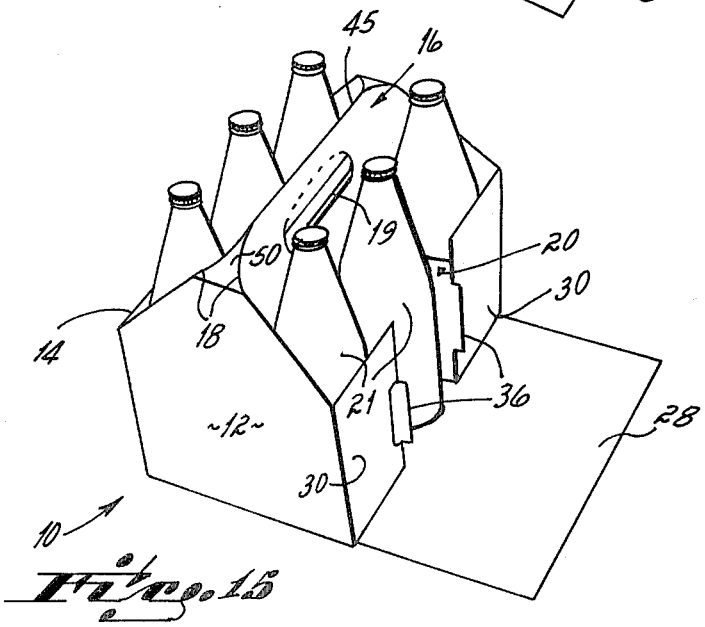

The gusset structure is first folded by reverse folding the hinge lines 43 between the two gusset sections with normal folding of the crease lines 41 and 51 of the gusset sections until the top wall attains the configuration shown in FIG. 11, creating generally triangular top panels 65. The triangular panels 65 are plowed down as indicated in FIG. 12 until they are at an inclined angle of approximately 45°. As the carrier continues to move in the direction of the arrow, bottles 21 are moved horizontally by side-loading elements into the four corners of the carrier as shown in FIG. 13. In moving into the four corners of the carrier, the bottles engage the panel 65 and gusset structure and snap the panels 65 into a generally vertical orientation, thereby creating the two-ply center partition 16, as shown in FIG. 13. Thereafter, the minor side flaps 30 are folded through an angle of 90° so as to be parallel to the center partition 16 and begin to enclose the bottles 21. In this attitude, the dividers 20 are slightly overlapped and parallel to the center partition 16, as shown in FIG. 14. A center bottle is then horizontally moved by the side loader into each side of the carrier past the dividers 20, thereby swinging the dividers inwardly through an angle of about 90° until they are perpendicular to the center panel and enclose the corner bottles. In swinging through 90°, the brace tab 36, broken out of the minor side flap 30, projects outwardly out of the plane of the side flap (FIGS. 3, 4 & 15).

Glue is applied to the major side flap 28 and it is plowed upwardly and forced into engagement with the minor side flap 30. It is pressed against the resisting surface of the bottle on the other side, thereby forming a vertical glue line which secures the major side flap to the minor side flap to finish the side walls 14, 15 and the carrier itself.

From the foregoing, a considerable number of advantageous features of the carrier should now be apparent. The complexity of the blank, as well as the converting operations, have been greatly reduced, thereby permitting the blank to be formed and folded with inexpensive, fast, straight line untimed gluers.

In the formation of the carrier at the side loader, the bottles are moved into the carrier in a horizontal direction, thereby minimizing the abrasion of the labels which occurs when bottles are loaded vertically and thus sliding against the exposed upper edges of the elements forming prior carriers.

The loading of the corner bottles provides the additional function of completing the creation of the center partition by snapping into place the gusset panels. The horizontal side loading of the center bottles completes the swinging into place of the divider flaps 20.

Figure 2:
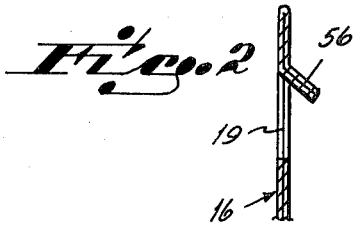
FIG. 2 is a cross-sectional view taken along lines 2—2 of FIG. 1*a;*
Figure 1A:
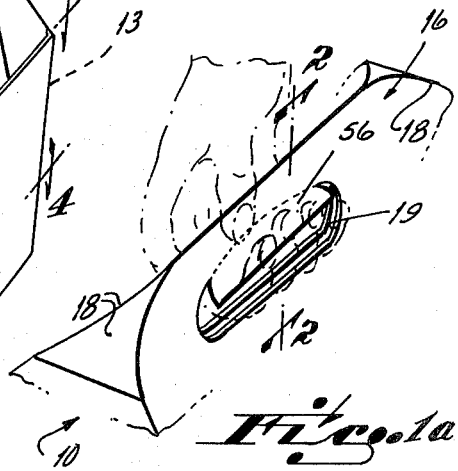

In appearance, the carrier has a clean, sculptured aspect which, primarily at the center partition, presents additional space for advertising copy. The center partition structure, particularly including the triangular end sections 50, enhance the structural characteristics of the carrier. Bracing and rigidity are imparted to the carrier by the curved, triangular sections. The curved, triangular sections save approximately 22 square inches per carrier over what would be required if the end panels 12 and 13 extended upwardly to the full height of the carrier. The center partition which forms the handle distributes the load evenly down the end walls of the carrier to the bottom of the carrier. The manner in which the finger-gripping area is formed, as illustrated in FIGS. 1*a* and 2, provides a cushion flap to make carrying of the filled 6-pack much more comfortable. Further, after release, the tab 56 returns generally to the plane of the center partition so that it will not interfere with the lifting of bottles out of the carrier by automatic uncasing apparatus at the bottler.

The bottom wall 11 is securely connected to all sides of the carrier so that there is no unsightly and disconcerting sag when bottles are lifted.

Additional cushioning is provided by the triangular sections 50 and the manner in which the gusset panels are spaced apart at each end of the carrier, thereby completing a cushion between the bottles at the ends of the carrier.

The bracing tabs on the center dividers cooperating with the major side flap perform two functions. They maintain the dividers in the perpendicular orientation with respect to the center partition and they create, with the minor and major side flaps, an additional cushioning effect, as illustrated at 69 in FIGS. 3 and 4.

Figure 16:
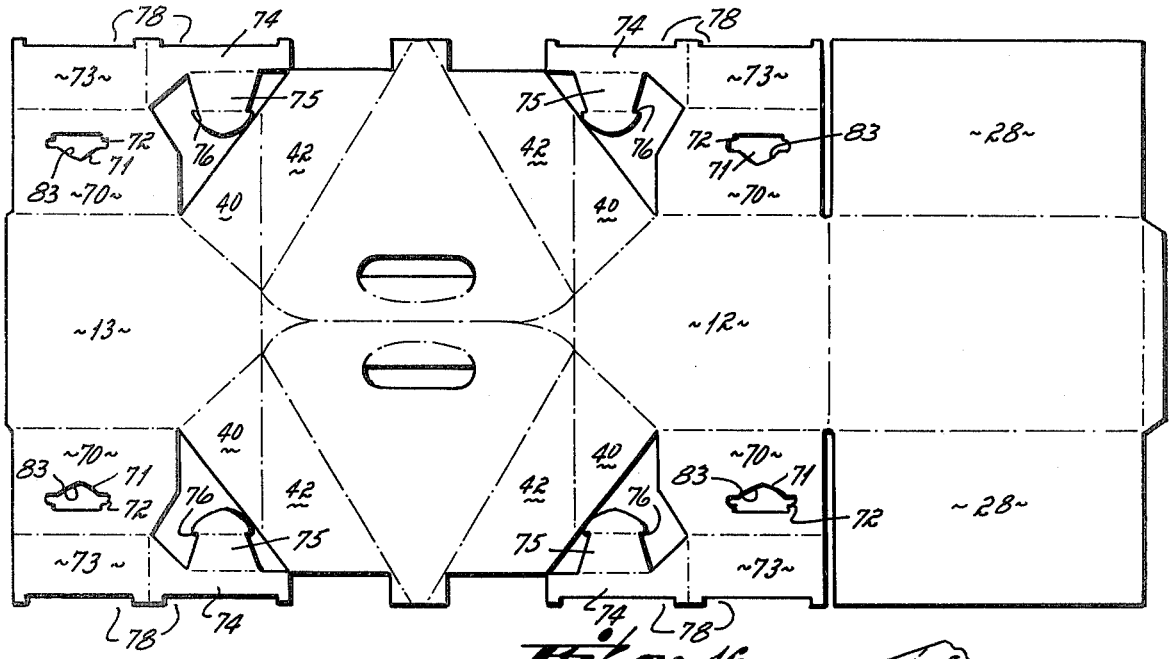
FIG. 16 is a plan view of a blank of an alternative form of the invention wherein the dividers have positive locking means.

An alternative form of the invention, particularly in relation to the right angle bracing of the center dividers, is shown in FIGS. 16–25. The blank illustrated in FIG. 16 is identical to the blank of FIG. 5 except for the minor flap and divider structure. That structure which is identical to the blank of FIG. 5 will therefore not be described.

Hinged to each of the end walls 12 and 13 is a minor flap 70 having a slot 71. The slot includes inwardly-projecting corners which have a locking function, as will be described. The double thickness divider is formed of a divider element 73 which is hinged to the minor flap 70 and a divider element 74 which is hinged to the divider element 73. The divider element 74 terminates in an arrowhead tab 75 having lateral barbs 76. As will be described below, the arrowhead tab is insertable into the slot 71, and when inserted, the barbs 76 will hook against the inwardly-projecting corners 72 to temporarily retain the arrowhead in the inserted position. The divider elements 73, 74 have mating cut-out portions 78 removed so that when the tabs are inserted past bottles in the container, the label areas passing under the cut-out portions will not be scuffed.

Figure 17:
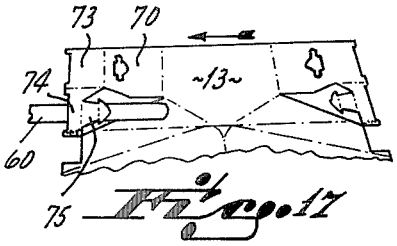
FIGS. 17–24 are fragmentary perspective views illustrating the formation of the alternative form of the invention.
Figure 18:
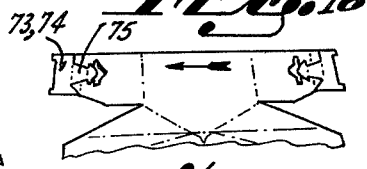

In the formation of the container, the steps described above in connection with the embodiment of FIGS. 1–15 are followed generally, with certain exceptions. FIG. 17 shows the blank moving in the direction of the arrow. The divider element 74 will be folded over by the plow 60 and glued to the divider element 73, as shown in FIG. 18. It will be noted in FIG. 18 that the arrowhead tab 75 lies immediately adjacent the slot 71. The blank is finally formed following the steps described in connection with FIGS. 6–9 by the converter and is ready for filling by the bottler. At the bottler, the container blank may be erected, formed and filled, as shown in FIGS. 10–15. In the final step where the center bottle 21 is moved into the center cell pushing the dividers ahead of it, the swinging of the divider elements 73, 74 through an angle of 90° automatically causes the arrowhead tab 75 to project into the slot 71 with the barbs hooking over the corners 72 of the slot. Thereafter, when glue is applied in the area which includes the tip of the tab 75, the tab will be glued to the major flap 28 along with the gluing of the major flap to the minor flaps 70. Thus, the inwardly-projecting divider elements 73, 74 will be securely held in an orientation perpendicular to the center partition 16 and the minor and major flaps.

Figure 19:
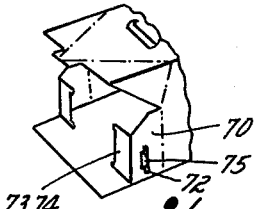

An alternative form of erecting, forming and loading the container is illustrated in FIGS. 19–25. After the carton has been erected into a right angle tube, as shown in FIG. 19, the divider elements 73, 74 are swung at an angle of 90° to the minor flap 70. In so swinging, the arrowhead tab 75 is thrust into the slot 71 with the barbs 76 hooking against the corner projections 72.

Figure 20:
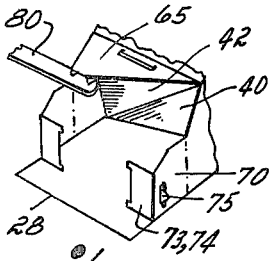

With the triangular panel 65 on each side of the container held at a slight upward angle by a plow 80, the gussets 40, 42 are positioned inwardly as shown in FIG. 20.

Figure 21:
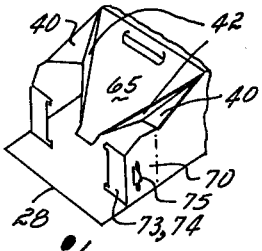
Figure 22:
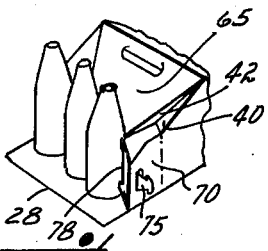
Figure 23:
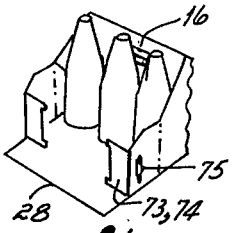
Figure 24:
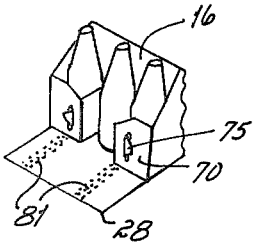
Figure 25:
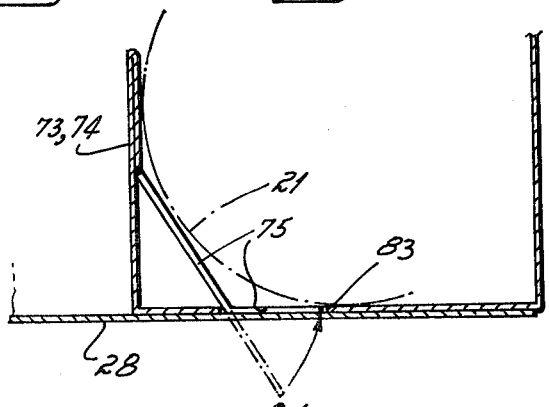
FIG. 25 is a cross-sectional view on a horizontal plane through a corner of a container to illustrate the locking divider.

As shown in FIG. 21, the top triangular panel 65 is plowed down to an angle of about 45°. In FIG. 22, there are shown three bottles being loaded into each side of the container as is customary in the machine of Pat. No. 3,225,510. There is no problem in moving the bottles past the divider flap and the minor flap 70, for both flaps are flexibly hinged and can move aside slightly to permit the entry of the bottles. The bottles move against the top triangular panel 65 and snap it into its downward orientation thereby creating the center partition 16 (FIG. 23). Thereafter, the divider flaps are plowed into position between the bottles as shown in FIG. 24. Glue is applied to the major panel 28 in the areas indicated at 81. When the major flap 28 is plowed up and pressed against the minor flap 70, the tip of the arrowhead 75 will be folded inwardly and lie in the plane of the minor flap with the glue causing it to adhere to the major flap 28 (FIG. 25). As can be seen particularly in FIG. 16, the slot 71 has a triangular cut-out area 83 matching the generally triangular tip of the tab 75 so that when the tip is forced inwardly by the major flap 28, it will not be sandwiched between the major and minor flaps but will lie in the plane of the minor flap.

Thus, with the alternative form of the invention as described in FIGS. 16–25, the dividers are permanently maintained in an orientation perpendicular to the center partition so as to define the cells which permit the container to make a second trip and to be top-loaded with bottles as from a drop packer.

Having described my invention, I claim:

1. A basket carrier for bottles comprising, four panels initially forming a tube having top, bottom and end walls, the top wall having at each of its four corners a gusset connection to a respective end wall, said top wall and gussets being folded inwardly along a central fold line to form a two-ply center partition, said end walls having minor flaps folded inwardly and said bottom wall having major flaps folded upwardly to form side walls spaced from said center partition, thereby providing pockets on both sides of said center partition for the receipt of bottles.

2. A carrier as in claim 1, each end wall having a trapezoidal upper portion terminating in a short fold line at the top thereof, and a triangular section connecting said short fold line to said plies forming said center partition, said triangular section tending to space the ends of said partition plies away from each other.

3. A carrier as in claim 1, each said gusset connection comprising, a minor gusset panel connected on one edge to said end wall, a major gusset panel connected respectively to said minor panel and said center partition, said gusset panels at each end of said carrier having common apexes at the top of said carrier and spaced from the center line of said carrier, said center partition having a center fold line whose ends are spaced inwardly from said end wall, at each end of said carrier, said fold line ends and said gusset apexes defining a triangular section which provides bracing and rigidity to said carrier.

4. A carrier as in claim 1 in which each of said minor flaps has an extension folded inwardly on a vertical fold line and generally perpendicular to said center partition to form dividers, said dividers being spaced apart to divide each side of said carrier into three receptacles for bottles.

5. A carrier as in claim 4 in which each divider is formed by folding a portion of said minor flap extension upon itself to form a two-ply divider.

6. A carrier as in claim 1 in which each of said minor flaps has an extension folded inwardly on a vertical fold line and generally perpendicular to said center partition to form a divider, said vertical fold line being interrupted by a shallow U cut into said minor flap to form a brace tab, said brace tab having an edge bearing against said major flap, said minor and major flaps being glued together with said brace tab frictionally retained in perpendicular attitude by engagement with said major flap regardless of the presence or absence of a bottle.

7. A carrier as in claim 1 in which the upper portion of each ply forming said center partition has a cushion tab cut from said ply, said cushion tab being connected to said ply by a shallow elongated arcuate score, said curved score limiting rotation of said cushion tab to about 90°, thereby providing a large, flat, finger-engaging surface as well as a memory causing said tab to return generally to the plane of said partition after finger pressure is removed.

8. A carrier as in claim 1 in which a portion of said center partition adjacent said handle is completely removed to leave a large hole with a shallow tab at the upper edge of said hole.

9. A basket carrier comprising, a bottom wall, two end walls hinged to said bottom wall, two side walls hinged to said bottom wall, and a two-ply center partition extending between said end walls, each ply of said partition being connected by a gusset structure at each end to respective end walls.

10. A carrier according to claim 9 in which said center partition plies are connected to each other on a fold line at the top of said carrier.

11. A carrier as in claim 9 further comprising, a pair of two-ply dividers in each side of said carrier, said dividers on each side of said carrier being spaced from each other and extending perpendicularly to said center partition to form three receptacles for three bottles.

12. In a paperboard carrier having a center partition, a handle in the center partition comprising, an elongated cushion tab cut from the upper portion of said center partition, said cushion tab being connected to said partition by a shallow elongated arcuate score, said curved score limiting rotation of said cushion tab to about 90° thereby providing a large flat finger-engaging surface as well as a memory causing said tab to return generally to the plane of said partition after finger pressure is removed.

13. The method of forming a bottle carrier comprising the steps of, forming a paperboard tube having a top wall, a bottom wall and two end walls, said top and end walls having gusset structures at the four upper corners of said tube, plowing both sides of said top wall partially downwardly to an inclined attitude, thrusting bottles horizontally into the four corners of said carrier against said inclined wall portions to swing said wall portions to a vertical attitude, thereby forming a two-ply center partition for said carrier, and forming side walls around said bottles.

14. The method of forming a bottle carrier as in claim 13 in which said bottom wall has major flaps extending laterally therefrom and in which said end walls have serially-connected minor flaps and dividers extending laterally therefrom, the method further comprising, swinging said minor flaps around said corner bottles, thrusting a center bottle into each side of the carrier to engage said dividers and swing them around said corner bottles to a position between said corner bottles and said center bottles, and swinging said major flap up and gluing it to said minor flaps on each side of said carrier.

15. The method of forming a bottle carrier comprising the steps of, forming a paperboard tube having a top wall, a bottom wall and two end walls, forming a center partition from said top wall which is perpendicular to said end walls, each said end wall having at opposed vertical edges a serially-connected minor side flap and divider, inserting bottles into four corners of said carrier against said partition, swinging said minor side flaps inwardly to a position parallel to said center partition, horizontally inserting a center bottle into each side of said carrier, said center bottle engaging and swinging said dividers inwardly about 90° with respect to said minor flaps to separate the corner bottles from said center bottles, said bottom wall having projecting major flaps, and swinging said major flaps upwardly and gluing them to said minor flaps.

16. A carrier as in claim 4, each said minor flap having a slot, each said divider having a tab projecting partially through said slot to form with said minor flap and divider a triangular bracing structure to maintain said divider perpendicular to said minor flap.

17. A carrier as in claim 16 in which said major flap is glued to the portion of said tab projecting through said slot.

18. A carrier as in claim 16 in which said tab has barbs and said slot has corner projections engageable by said barbs to temporarily retain said tab in said slot.

* * * * *